US005669242A

United States Patent [19]

Cayton

[11] Patent Number: 5,669,242

[45] Date of Patent: Sep. 23, 1997

[54] NECKLACE EXTENSION ACCESSORY

[76] Inventor: Meryl L. Cayton, 12 Brian Ct., Northport, N.Y. 11768

[21] Appl. No.: 405,525

[22] Filed: Mar. 16, 1995

[51] Int. Cl.[6] ..... A44C 19/00

[52] U.S. Cl. ..... 63/21; 24/299; 24/698.3

[58] Field of Search ..... 63/2, 21, 4; 24/299, 24/698.3, 601.8, 601.9

[56] References Cited

U.S. PATENT DOCUMENTS

| | | | |
|---|---|---|---|
| 794,695 | 7/1905 | Bagnall | 63/21 |
| 2,820,269 | 1/1958 | Wolff . | |
| 3,224,060 | 12/1965 | Ogden | 63/2 |
| 4,123,900 | 11/1978 | Sadowski | 24/698.3 |
| 4,170,962 | 10/1979 | Limbaugh | 24/299 |
| 4,654,936 | 4/1987 | Courtney | 24/698.3 |
| 5,148,689 | 9/1992 | Azrielant | 63/2 |
| 5,414,903 | 5/1995 | Porteous . | |

FOREIGN PATENT DOCUMENTS

| | | | |
|---|---|---|---|
| 2142719 | 2/1985 | United Kingdom | 63/21 |
| 2274236 | 7/1994 | United Kingdom | 62/2 |

*Primary Examiner*—Flemming Saether

*Attorney, Agent, or Firm*—Cohen, Pontani Lieberman & Pavane

[57] ABSTRACT

A necklace accessory for a base necklace includes a slender supplemental member, and first and second hooks secured to respective portions of the supplemental member in spaced relation to one another. The first and second hooks are each able to releasably ensnare respective portions of the base necklace in spaced relation along the length of the base necklace to form a composite necklace having a circumferential first portion defined by the base necklace and a circumferential second portion defined by the supplemental member.

13 Claims, 3 Drawing Sheets

NECKLACE EXTENSION ACCESSORY

FIELD OF THE INVENTION invention relates to an accessory for a necklace and, more particularly, to a chain, cord, wire or the like releasably connectable to the necklace to form a composite necklace in which the necklace and chain, cord, wire or the like are combined.

BACKGROUND OF THE INVENTION

Extension chains for increasing the lengths of necklaces are known. Such an extension chain typically has one end to which is secured a conventional spring-loaded clasp of the type commonly found on necklaces and an opposite end to which is secured a loop member, often a ring. A typical necklace similarly has a clasp, usually spring-loaded, secured to one end and a loop member, often ring-shaped, secured to the other end.

The extension chain is normally connected to the necklace by opening and holding open one of the spring-loaded clasps, for example the clasp secured to the extension chain, while the loop member secured to the necklace is slipped over one of the ends of the clasp whereupon the clasp is released and closed by the spring-loading thereof. Likewise, the spring-loaded clasp secured to the necklace is opened and held open while the loop member secured to the extension chain is slipped over one of the ends of the clasp whereupon the clasp is released and closed by the spring-loading thereof.

A composite necklace is thereby formed having a circumferential first portion defined by the necklace (hereinafter referred to as the "base necklace") and a circumferential second portion defined by the extension chain. The length of the composite necklace exceeds the length of the base necklace by an amount equal to the length of the extension chain. By placing the composite necklace on the shoulders of the wearer so that the extension chain is hidden from view, the visual, effect of the composite necklace is equivalent to that of the base necklace having an increased length equal to the length of the composite necklace.

Each spring-loaded clasp is typically opened by moving a short, thin post relative to the body of the clasp against the force of the spring-loading to create a gap in the body of the clasp. The post is held in this position while the loop member is slipped over one of the ends of the clasp. Moving the post sufficiently to create the gap in the body of the clasp, and holding the post against the spring-loading to maintain the gap, may be extremely difficult, if not impossible, for individuals with weak hands.

The short, thin post is usually moved to open the clasp by being forcibly engaged by the end of the finger or fingernail of the user. If the post is sufficiently short or thin, or the spring-loading is sufficiently strong, a large contact force may develop between the post and the end of the finger or fingernail in engagement therewith, and produce discomfort in or even injury to the area of the finger or fingernail in direct contact with the post.

Additionally, considerable dexterity is usually required to insert each loop member through the typically small gap in the open clasp and slip the loop member over one of the ends thereof so that, when the clasp is closed, the clasp retains the loop member. Such manipulations may be difficult, particularly for people, for example, with poor eyesight, nervous disorders affecting motor skills, or large hands.

Moreover, when a conventional extension chain having a clasp secured to one end and a loop member secured to the other end is connected to a base necklace, the base necklace must normally include at least one clasp which is connectable to the extension chain, usually the loop member thereof. Use of a conventional extension chain may therefore be precluded with a base necklace which is separatable by means other than a conventional clasp, such as a magnetic clasp.

SUMMARY OF THE INVENTION

According to one aspect of the present invention, a necklace accessory for a base necklace includes a slender supplemental member, and first and second hooks secured to respective portions of the supplemental member in spaced relation to one another along the length of the supplemental member. The first and second hooks are each able to releasably ensnare respective portions of the base necklace in spaced relation to one another along the length of the base necklace to form a composite necklace having a circumferential first portion defined by the base necklace and a circumferential second portion defined by the supplemental member.

The structure of the hooks of the necklace accessory is simpler than that of a conventional spring-loaded clasp which is typically opened by moving a post against the spring-loading of the clasp. As a result, the hooks will normally be easier to manufacture and less dexterity will be required to perform the manipulations necessary to connect and disconnect the hooks to and from the base necklace. Also, people who, because of weak hands, are able to manipulate spring-loaded clasps only with extreme difficulty, if at all, may be able use the hooks of the present invention. In addition, the hooks do not produce the large contact force which may develop between the post of a spring-loaded clasp and a finger or fingernail in engagement therewith.

Moreover, the hooks of the present invention may ensnare portions of the base necklace intermediate the ends thereof thereby enabling connection of the necklace accessory to a base necklace which is "closed," i.e., not separated. The circumferential first portion of the resulting composite necklace includes a plurality of strands equal in number to a multiple of the number of strands of the base necklace. The appearance or visual effect of the composite necklace created by this assembly differs markedly from that produced by connecting the ends of an extension chain to respective ends of an open or separated base necklace. The necklace accessory may thereby be used to form two different composite necklaces having different appearances or visual effects from a single separatable base necklace thereby increasing the versatility, from a fashion standpoint, of a such a necklace.

Additionally, many decorative necklaces lack a clasp or similar structure, such as necklaces having a length which is larger than the circumference of the wearer's head and are placed over the head of the wearer without being separated. Base necklaces may also have strands which are sufficiently elastic to be placed over the wearer's head without opening the necklace. Since the necklace accessory of the present invention includes two hooks, it enables formation of composite necklaces including base necklaces which are not separatable, thereby enabling the appearance or visual effect of such necklaces to be altered.

The various features of novelty which characterize the invention are pointed out with particularity in the claims annexed to and forming a part of this disclosure. For a better understanding of the invention, its operating advantages, and specific objects attained by its use, reference should be made to the following detailed description in conjunction with the accompanying drawings in which there are illustrated and described currently preferred embodiments of the invention. It is to be understood, however, that the detailed description and drawings are intended to illustrate and not to define the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
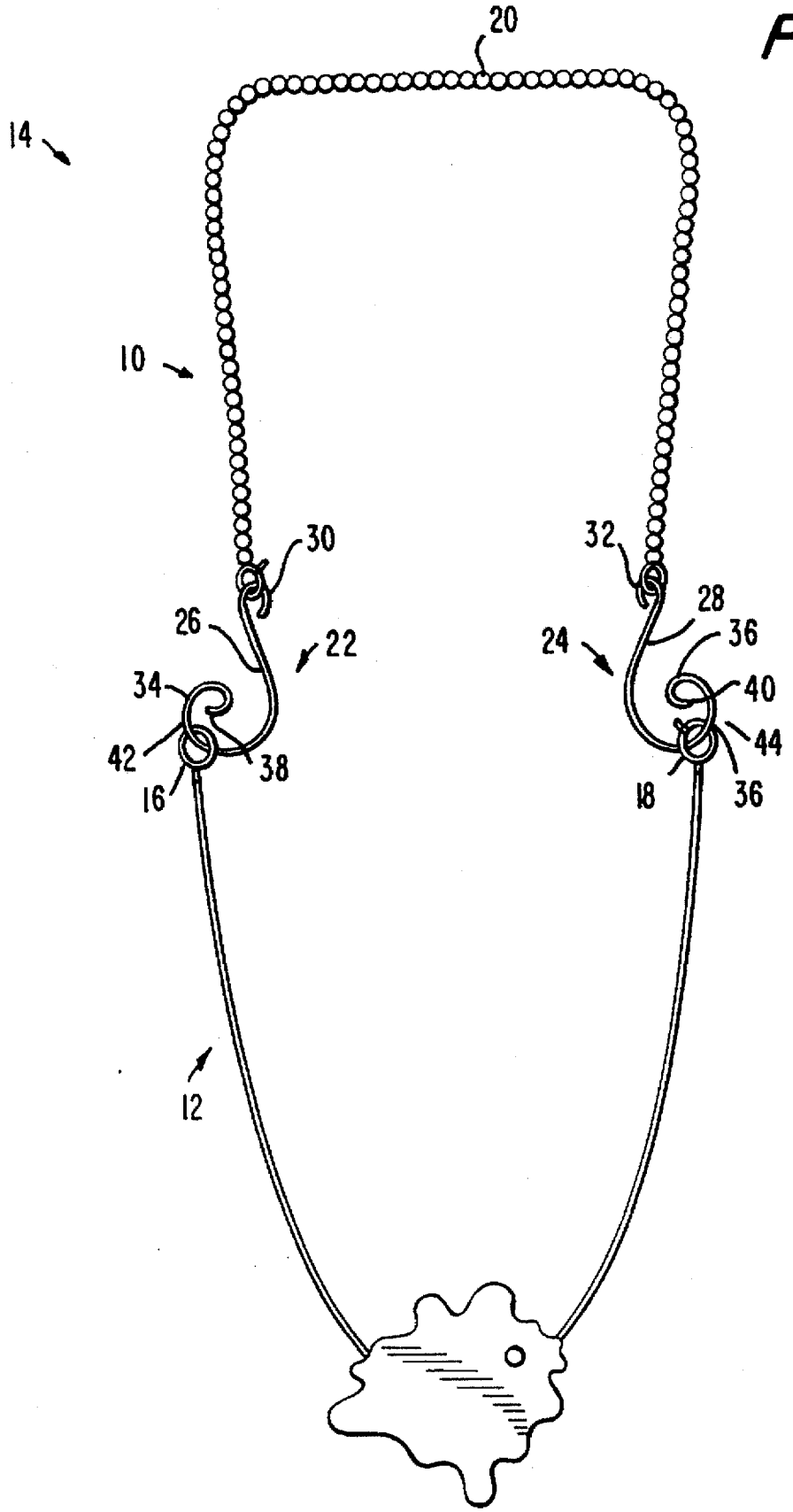
FIG. 1 is a front elevational view of a necklace accessory constructed in accordance with the present invention having hooks on each end which are threaded through a clasp and loop member on the ends of a base necklace to form a composite necklace defined by the base necklace and necklace accessory.

Referring now to the drawings, FIG. 1 illustrates a necklace accessory identified by the general reference number 10 and constructed in accordance with the teachings of the present invention. As will be described further hereinbelow, the necklace accessory 10 is connected to a base necklace 12 to form a composite necklace 14 having a circumferential first portion defined by base necklace 12 and a circumferential second portion defined by necklace accessory 10.

Base Necklace

"Base necklace", as used herein, refers to the decorative necklace 12 to which necklace accessory 10 is connected. "Composite necklace", as used herein, refers to necklace 14 resulting from connecting necklace accessory 10 to base necklace 12, in accordance with the teachings of the present invention. The composite necklace 14 gives the base necklace 12 a different appearance or visual effect as compared to that of base necklace 12 alone.

The base necklace 12 may be any of the various conventional decorative necklaces normally worn as jewelry. If, however, base necklace 12 is connected to necklace accessory 10 as shown in FIG. 1 and described hereinbelow, base necklace 12 must be separatable, and preferably releasably separatable, at some point along the length thereof. Secured to one end of base necklace 12 is a loop member 16 defined by a ring-shaped link. Secured to the other end of base necklace 12 is a safety clasp 18 releasably linkable to loop member 16 when, for example, a person wishes to wear the base necklace without necklace accessory 10. Spring-loaded loaded ring-shaped safety clasps, such as clasp 18, are common to many conventional base necklaces.

Those skilled in the art will appreciate, however, that loop member 16 and clasp 18 having other constructions may be used with the present invention. For example, clasp 18 may be completely detachable from base necklace 12 so that, when the clasp is so detached, a respective loop member defined by a ring-shaped member, such as 16, is left at each end of the base necklace.

The composite necklace 14 is preferably worn with the maximum possible extent of necklace accessory 10 juxtaposed across the back of the neck of a wearer because the portion of the composite necklace on the back of the neck, which may include all or part of the necklace accessory, will normally be hidden from the view of at least persons facing the wearer. Accordingly, it is preferable for the necklace accessory to be shaped or have sufficient flexibility to readily conform to the back of the wearer's neck.

The portion of composite necklace 14 on the back of the wearer's neck, or at least a part thereof, may be further hidden from view if covered by an article of clothing on the shoulders of the wearer, a hat or hood, or the hair of the wearer if sufficiently long and thick. It is therefore most preferable for necklace accessory 10 to have a length which is sufficiently limited to enable complete coverage thereof by such an item disposed on or adjacent the back of the wearer's neck. The appearance or visual effect of the composite necklace 14 may thereby be defined solely by base necklace 12.

Necklace Accessory

In the embodiment illustrated in FIG. 1, necklace accessory 10 includes a slender supplemental member 20 defined by a chain, and first and second hook means defined by first and second hooks 22, 24, respectively, secured to the supplemental member in spaced relation to one another along the length of the supplemental member. The hooks 22, 24 are preferably secured to the ends of supplemental member 20, although it is within the scope of the present invention that the hooks may alternatively be connected to the supplemental member inwardly of the ends thereof as long as the hooks have the aforementioned spaced relation to one another.

The first and second hooks 22, 24 include respective first and second shanks 26, 28 each having a connector 30, 32 at one end thereof. Each connector 30, 32 is threaded through a respective link on opposite ends of supplemental member 20 and curves back onto itself to secure the first and second hooks to the supplemental member. Extending from the ends of first and second shanks 26, 28 opposite the respective connectors 30, 32 are respective first and second curled portions 34, 36 having free ends 38, 40, respectively, opposite their respective shanks such that the first and second curled portions are between the first and second shanks 26, 28 and free ends 38, 40, respectively. The first and second curled portions 34, 36 define first and second tortuous or circuitous paths 42, 44, respectively, between free ends 38, 40 and first and second shanks 26, 28.

The hooks 22, 24 are formed of a material which is light-weight for the comfort of the wearer but also sufficiently stiff to deflect nominally, if at all, when subjected to the loads resulting from the weight of base necklace 12. Such loads may be significant depending upon the size of base necklace 12. A typical material for hooks 22, 24 is 14 gauge sterling silver wire, although other materials may be used within the scope of the invention.

The cross sectional area of first curled portion 34 is sufficiently small so that, when clasp 18 is detached from loop member 16, the loop member may be slipped over free end 38 and moved to a position along the length of the first curled portion 34. The cross sectional area of second curled portion 36 is similarly sized relative to clasp 18 such that the clasp may be slipped over free end 40 and located on second curled portion 36 inwardly of free end 40. Connecting base necklace 12 and necklace accessory 10 in this fashion produces composite necklace 14 which gives the appearance or visual effect of the base necklace with a length which is greater than the actual length thereof.

The loop member 16 and clasp 18 are forced to follow first and second tortuous or circuitous paths 42, 44 relative to first and second hooks 22, 24 during connection thereto. This results in a more secure connection between loop member 16, clasp 18 and hooks 22, 24 because it would be highly unlikely, if not impossible, for a wearer of composite necklace 14 to inadvertently make the sequence of bodily movements necessary to displace loop member 16 and clasp 18 along first and second tortuous paths 42, 44 to detach the loop and/or clasp portion from the hooks. While the shape of tortuous paths 42, 44 may result in added manipulation being required when connecting loop member 16 and clasp 18 to first and second curled portions 34, 36, any additional effort is minimal in view of the additional security provided by the tortuous or circuitous paths.

"Curled portion", in the contemplation of the present invention and context of this disclosure, is intended to be construed broadly to include each portion of first and second hooks 22, 24 between free end 38, 40 and first and second shanks 26, 28 having a bent or curved shape which will enable the hooks to snare, catch, grasp or the like base necklace 12 according to the teachings of the present invention. For example, replacing first curled portion 34 with a "U-shaped" curled portion may provide a connection between necklace accessory 10 and base necklace 12 for forming composite necklace 14 if loop member 16 or clasp 18 are slipped over the free end of such a "U-shaped" curled portion, comparable to free end 38, and disposed in the trough thereof.

Figure 2:
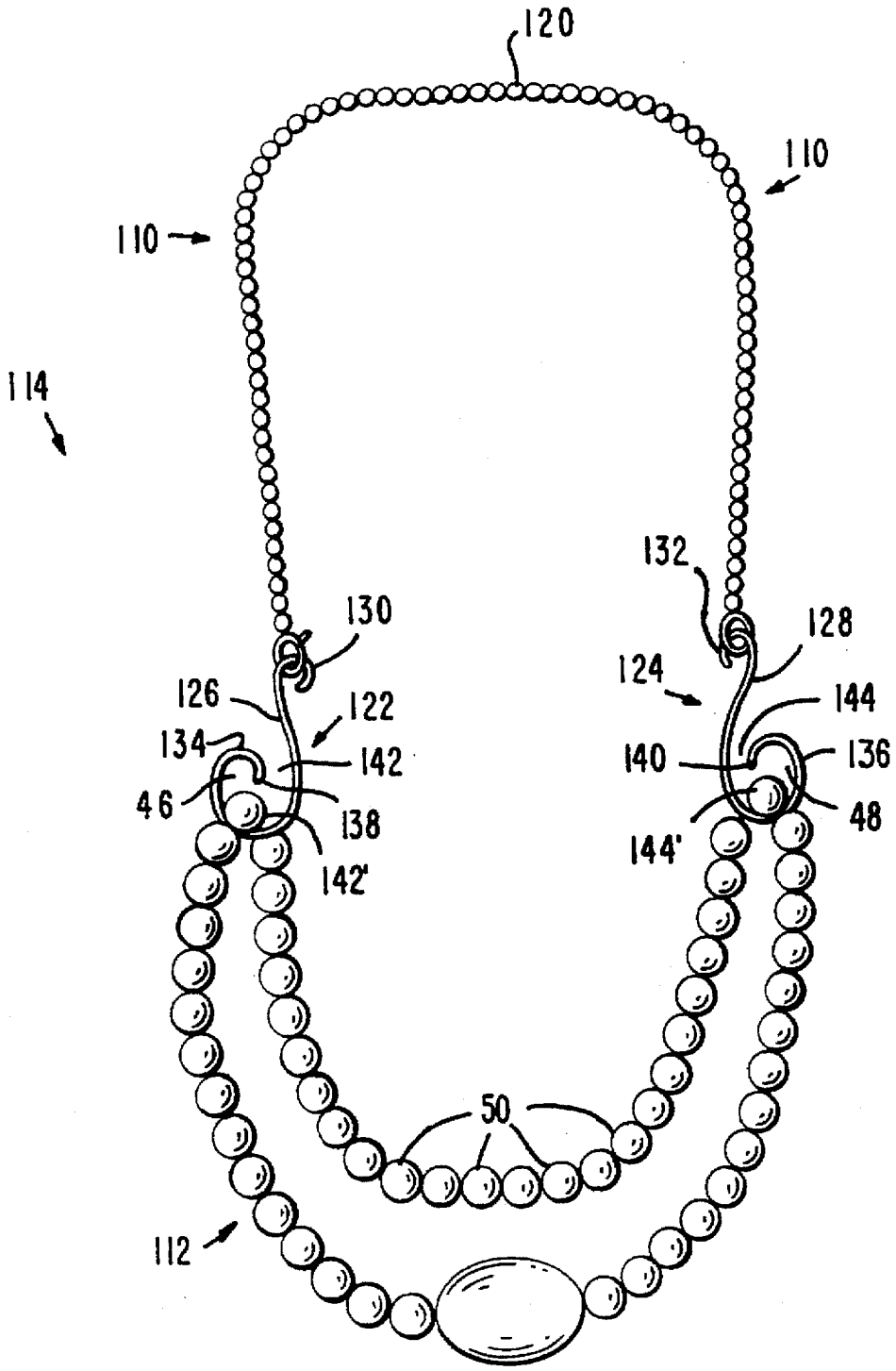
FIG. 2 is a front elevational view of the necklace accessory of FIG. 1 wherein the base necklace defines a closed, continuous curve which is looped through the hooks such that the portion of the composite necklace defined by the base necklace includes a multiple of the number of strands of the base necklace.

FIG. 2 is a front elevational view, similar to FIG. 1, of base necklace 112 connected to necklace accessory 110 by an alternative mode of connection in which the first and second hook means are defined by first and second hooks 122, 124, respectively. FIG. 2 elements similar to those depicted in FIG. 1 have like reference numerals with the addition (in FIG. 2) of the prefix 100.

In order to establish the connection between base necklace 112 and first and second hooks 122, 124 of necklace accessory 110 shown in FIG. 2, the base necklace must define a closed, continuous curve, i.e., there must be no discontinuity or separation of the base necklace caused, for example, by opening a clasp, such as clasp 18 in FIG. 1. In other words, if base necklace 112 has an operable clasp, it will remain closed when the necklace accessory 110 is used in the manner shown in FIG. 2 whereby the base necklace itself defines a closed, continuous loop. Accordingly, the connection illustrated in FIG. 2 may also be made with a base necklace 112 not having any clasp or other releasable fastener interposed therein, i.e., a base necklace which is not releasably separatable.

The first and second hooks 122, 124 are similar in structure to aforementioned hooks 22, 24 depicted in FIG. 1 and include first and second curled portions 134, 136 shaped to provide first and second tortuous or circuitous path 142, 144, respectively, leading to first and second interior captive regions 46, 48. It will be understood that first and second curled portions 134, 136 having shapes different from those shown in FIG. 2 are also within the scope and contemplation of the present invention consistent with the definition of "curled portion" as set forth hereinabove.

The first and second tortuous paths 142, 144 each become narrowest at first and second throats designated by the reference numerals 142', 144', respectively, between free ends 138, 140 and curled portions 134, 136. The base necklace 112 depicted in FIG. 2 has portions which are smaller in cross section than throats 142', 144', such as where pearls 50 or other bead-like elements tangentially abut one another, and portions which are larger in cross section than the first and second throats, such as the central regions of pearls 50.

The base necklace 112 is connected to first and second hooks 122, 124 by inserting a portion of the base necklace into tortuous paths 142, 144 and moving the base necklace portions through the respective paths toward first and second throats 142', 144'. The portions of base necklace 112 having cross sections which are smaller than throats 142', 144' enable base necklace to pass therethrough into first and second captive regions 46, 48 for looping the base necklace through hooks 122, 124 as shown in FIG. 2. As a result, the length of the circumferential portion of composite necklace 114 defined by base necklace 112 is less than the circumference of the closed, continuous base necklace. The composite necklace 114 also gives base necklace 112 the appearance of having more parallel strands than when the base necklace is worn without accessory 110, thereby further increasing the versatility, from a fashion standpoint, of the base necklace.

Once inside first and second captive regions 46, 48, base necklace 112 may move freely through the plane defined by the captive regions since the first and second captive regions are larger than even the largest cross section of the base necklace. That is, pearls 50 may be pulled through the openings defined by first and second captive regions 46, 48 in one direction or the other for varying the lengths of the two apparent strands of the base necklace 112 in FIG. 2. This adjustment of the relative lengths of the parallel strands of base necklace 112 provides further opportunities for varying the appearance thereof.

The base necklace 112 may be removed from first and second captive regions 46, 48 by displacing the base necklace along tortuous paths 142, 144 away from the captive regions toward first and second shanks 126, 128. In order to pass through throats 142', 144', base necklace 112 must be aligned such that the portions thereof having a smaller cross section than that of the throats, i.e. the spaces between pearls 50, are aligned with the first and second throats. When base necklace 112 exits from first and second tortuous paths 142, 144, it is readily slipped over curled portions 134, 136 for disconnecting base necklace 112 from necklace accessory 110.

As should now be apparent, first and second tortuous or circuitous paths 142, 144 provide a more secure connection between base necklace 112 and hooks 122, 124 since, in order for the base necklace situated in first and second captive regions 46, 48 to become detached from the hooks, the base necklace must follow a path requiring a series of specific directional changes, including alignment of reduced cross sectional portions of the base necklace with first and second throats 142', 144'. The likelihood of producing such movements in the correct sequence from ordinary, everyday movements of the wearer of composite necklace 114 is extremely remote. Rather, disconnection of base necklace 112 from first and second hooks 122, 124 requires a conscious, deliberate effort by the wearer of composite necklace 114 to correctly manipulate the base necklace relative to the hooks. Accordingly, inadvertent or accidental detachment of base necklace 112 from necklace accessory 110 is extremely unlikely if not impossible.

It should be appreciated that the curvature of curled portions 134, 136 has an upper limit in that the cross sectional areas of tortuous paths 142, 144 throughout the lengths thereof must be sufficiently large to allow passage of at least a portion of base necklace 112 to first and second captive regions 46, 48.

Figure 3:
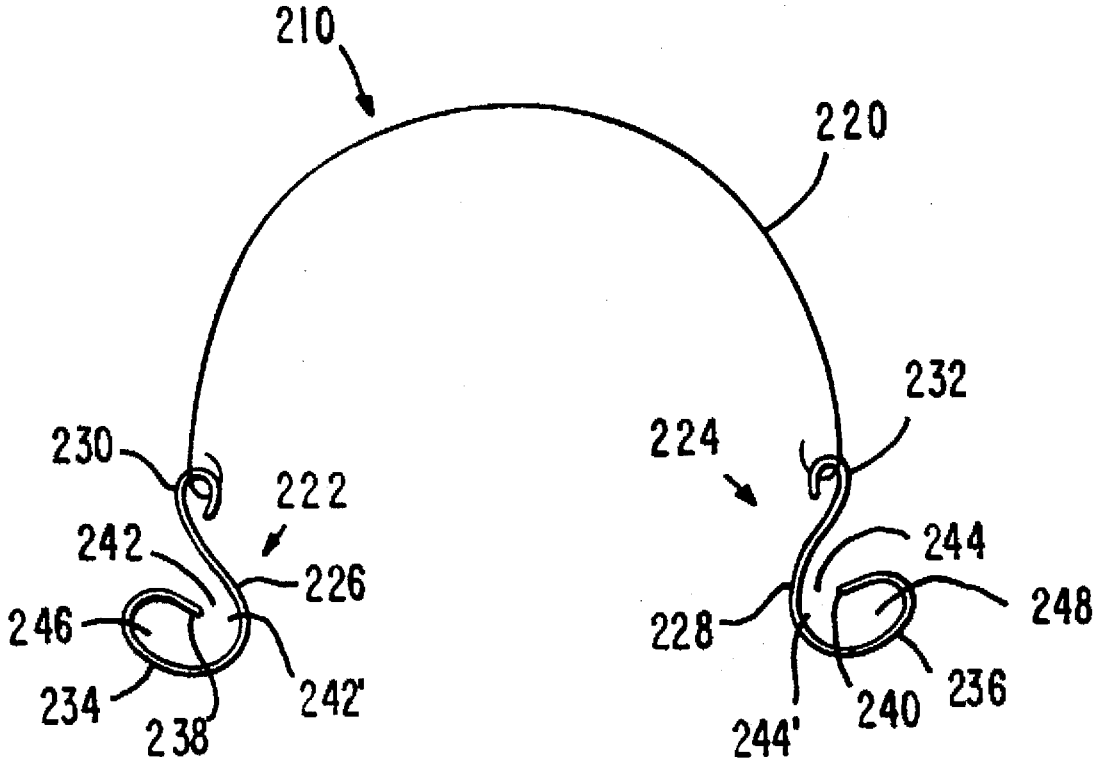
FIG. 3 is front elevational view of another embodiment of the necklace accessory of FIG. 1 wherein the supplemental member is defined by a wire.

FIG. 3 is a front elevational view, similar to FIG. 1, of another embodiment of the necklace accessory 210 of the present invention. Elements in FIG. 3 similar to those depicted in FIG. 1 have like reference numerals with the addition (in FIG. 3) of the prefix 200.

The embodiment of necklace accessory 210 shown in FIG. 3 includes a supplemental member 220 defined by a wire, as compared to the chain illustrated in FIGS. 1 and 2. Those skilled in the art will recognize that supplemental member 220 may also be a cord or the like so long as the supplemental member has the necessary strength to support the base necklace, e.g. 12, 112, which, when in use, normally hangs downwardly from first and second hooks 22, 24, 122, 124, as shown in FIGS. 1 and 2. In other respects, necklace accessory 210 may be the same as necklace accessories 10, 110 and is connected to a base necklace, e.g., 12, 112, according to the method used for connecting necklace accessories 10, 110 to their respective base necklaces 12, 112.

It will be understood that, within the scope of the present invention, the first and second hook means may be defined by alternative structures equivalent to the first and second hooks disclosed hereinabove, including hooks 22, 24, 122, 124, 222, 224, and able to releasably ensnare respective portions of a base necklace, e.g., 12, 112, in spaced relation to one another along the length of the base necklace. For example, the first and second hook means may be defined by brackets, cup-like structures or the like. Additionally, the first and second hook means may be defined by respective receptacles each having a labryinth-like interior for receiving respective portions of a base necklace, e.g., 12, 112, for releasable securement therein. Accordingly, when ascertaining the scope of the present invention, "hook means", as used herein, is to be construed to include all structures described hereinabove as usable therefor and equivalents thereof which perform the required function.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the an without departing from the spirit of the invention. For example, it is expressly intended that all combinations of those elements and/or method steps which perform substantially the same function in substantially the same way to achieve the same result are within the scope of the invention. It is the intention, therefore, to be limited only as indicated by the scope of the claims appended hereto.

What is claimed is:

1. A necklace extension accessory for use with a base necklace, said base necklace having a first portion and a second portion, said necklace extension accessory comprising:

a slender supplemental member having a first end and a second end, wherein said first end has a first opening defined therein and said second end has a second opening defined therein;

first releasable hook means comprising a first integral member having a first connector threaded through said first opening and curving back onto itself for attaching said first releasable hook means to said first end of said supplemental member, and a first hook portion for releasably ensnaring the first portion of said base necklace; and second releasable hook means comprising a second integral member having a second connector threaded through said second opening and curving back onto itself for attaching said second releasable hook means to said second end of said supplemental member, and a second hook portion for releasably ensnaring the second portion of said base necklace, wherein when both the first and the second portions of said base necklace are ensnared by said respective releasable hook means, a composite necklace having a circumferential first portion defined by the base necklace and a circumferential second portion defined by said supplemental member is thereby formed.

2. A necklace extension accessory according to claim 1, wherein said first hook portion comprises a first curled portion extending from said first integral member such that said first integral member is disposed between said first curled portion extending therefrom and said first end of said supplemental member, said first curled portion defining a first interior captive region and a first tortuous path leading thereto such that, when said base necklace is ensnared by said first hook means, said first portion of the base necklace is inserted into said first captive region via said first tortuous path whereby the base necklace is removable from said first captive region only via said first tortuous path such that disconnection of said base necklace from said first hook means is impeded.

3. A necklace extension accessory according to claim 1, wherein said second hook portion comprises a second curled portion extending from said second integral member such that said second integral member is disposed between said second curled portion extending therefrom and said second end of said supplemental member, said second cuffed portion of said second releasable hook means defining a second interior captive region and a second tortuous path leading thereto such that, when said base necklace is ensnared by said second releasable hook means, said second portion of the base necklace is inserted into said second captive region via said second tortuous path whereby the base necklace is removable from said second captive region only via said second tortuous path such that disconnection of said base necklace from said second releasable hook means is impeded.

4. A necklace extension accessory according to claim 1, wherein said supplemental member comprises a chain.

5. A necklace extension accessory according to claim 1, wherein said supplemental member comprises a wire.

6. A necklace extension accessory for use with a base necklace, said base necklace comprising a primary end and a secondary end, wherein the primary end of said base necklace is defined by a loop member, and the secondary end of said base necklace is defined by a clasp releasably linkable to said loop member, said necklace extension accessory comprising:

a slender supplemental member having a first end and a second end, wherein said first end has a first opening defined therein and said second end has a second opening defined therein;

first releasable hook means comprising a first integral member having a first connector threaded through said first opening and curving back onto itself for attaching said first releasable hook means to said supplemental member, and a first curled portion extending from said first integral member, such that said first integral member is disposed between said first curled portion extending therefrom and said first end, said first curled portion having a first free outer end opposite said first integral member, and a sufficiently small cross sectional area such that, when said clasp is detached from said loop member, one of said clasp and said loop member may be slipped over said first free outer end and located on said first curled portion inwardly of said first free outer end for enabling said first releasable hook means to releasably ensnare said one of said clasp and said loop member; and second releasable hook means comprising a second integral member having a second connector threaded through said second opening and curving back onto itself for attaching said second releasable hook means to said supplemental member, and a second curled portion extending from said second integral member, such that said second integral member is disposed between said second curled portion extending therefrom and said second end, said second curled portion having a second free outer end opposite said second integral member, and a sufficiently small cross sectional area such that, when said clasp is detached from said loop member, the other of said clasp and said loop member may be slipped over said second free outer end and located on said second curled portion inwardly of said second free outer end for enabling said second releasable hook means to releasably ensnare said other of said clasp and said loop member.

7. A necklace extension accessory according to claim 6, wherein said supplemental member comprises a chain.

8. A necklace extension accessory according to claim 6, wherein said supplemental member comprises a wire.

9. A combination base necklace and necklace extension accessory comprising:

a base necklace having a first portion and a second portion;

a necklace extension accessory comprising:

a slender supplemental member having a first end and a second end, wherein said first end has a first opening defined therein and said second end has a second opening defined therein;

first releasable hook means comprising a first integral member having a first connector threaded through said first opening and curving back onto itself for attaching said first releasable hook means to said first end of said supplemental member, and a first hook portion for releasably ensnaring the first portion of said base necklace; and second releasable hook means comprising a second integral member having a second connector threaded through said second opening and curving back onto itself for attaching said second releasable hook means to said second end of said supplemental member, and a second hook portion for releasably ensnaring the second portion of said base necklace, wherein when both the first and the second portions of said base necklace are ensnared by said respective releasable hook means, a composite necklace having a circumferential first portion defined by the base necklace and a circumferential second portion defined by said supplemental member is thereby formed.

10. A necklace extension accessory according to claim 9, wherein said first hook portion comprises a first curled portion extending from said first integral member such that said first integral member is disposed between said first curled portion extending therefrom and said first end of said supplemental member, said first curled portion defining a first interior captive region and a first tortuous path leading thereto such that, when said base necklace is ensnared by said first hook means, said first portion of the base necklace is inserted into said first captive region via said first tortuous path whereby the base necklace is removable from said first captive region only via said first tortuous path such that disconnection of said base necklace from said first hook means is impeded.

11. A necklace extension accessory according to claim 10, wherein said second hook portion comprises a second curled portion extending from said second integral member such that said second integral member is disposed between said second curled portion extending therefrom and said second end of said supplemental member, said second curled portion of said second releasable hook means defining a second interior captive region and a second tortuous path leading thereto such that, when said base necklace is ensnared by said second releasable hook means, said second portion of the base necklace is inserted into said second captive region via said second tortuous path whereby the base necklace is removable from said second captive region only via said second tortuous path such that disconnection of said base necklace from said second releasable hook means is impeded.

12. A necklace extension accessory according to claim 9, wherein said supplemental member comprises a chain.

13. A necklace extension accessory according to claim 9, wherein said supplemental member comprises a wire.

* * * * *